United States Patent [19]

Johnson

[11] Patent Number: 4,615,790

[45] Date of Patent: Oct. 7, 1986

[54] PREPARATION OF SYNTHETIC HYDROCARBON LUBRICANTS

[75] Inventor: Thomas H. Johnson, Houston, Tex.

[73] Assignee: Shell Oil Company, Houston, Tex.

[21] Appl. No.: 791,660

[22] Filed: Oct. 28, 1985

[51] Int. Cl.[4] ..... C10G 71/00; C07C 2/24

[52] U.S. Cl. ..... 208/18; 585/7; 585/12; 585/517; 585/326; 585/329

[58] Field of Search ..... 585/7, 12, 517, 326, 585/329, 5; 208/18

[56] References Cited

U.S. PATENT DOCUMENTS

| | | | |
|---|---|---|---|
| 2,315,080 | 3/1943 | Reid | 585/517 |
| 2,385,237 | 9/1945 | Stahly et al. | 585/517 |
| 2,490,578 | 12/1949 | Carmody | 585/517 |
| 2,622,113 | 12/1952 | Hervert | 585/517 |
| 3,409,703 | 11/1968 | Engelbrecht | 585/517 |
| 3,590,094 | 4/1968 | Reusser et al. | 585/329 |
| 4,263,465 | 4/1981 | Sheng et al. | 585/12 |
| 4,268,701 | 5/1981 | Dang Vu et al. | 585/329 |
| 4,362,650 | 5/1981 | Chauvin et al. | 502/117 |
| 4,366,087 | 12/1982 | Le Pennec et al. | 585/502 |
| 4,398,049 | 8/1983 | Le Pennec et al. | 585/512 |
| 4,404,415 | 9/1983 | Gaillard | 585/12 |
| 4,420,646 | 12/1983 | Darden et al. | 585/12 |
| 4,469,912 | 9/1984 | Blewett et al. | 585/329 |
| 4,476,343 | 10/1984 | Johnson | 585/530 |
| 4,489,171 | 12/1984 | Johnson | 585/231 |

OTHER PUBLICATIONS

Hydrocarbon Processing, May 1982, Another Use for Dimersol, pp. 110–112, Gaillard et al.

*Primary Examiner*—Andrew H. Metz
*Assistant Examiner*—Helane Myers

[57] ABSTRACT

Synthetic hydrocarbon lubricating materials are produced by cross oligomerizing a Dimersol olefin and a linear olefin with a catalyst comprising a metal oxide substrate having tantalum (v) halide/oxide bound to the surface thereof.

6 Claims, 1 Drawing Figure

PREPARATION OF SYNTHETIC HYDROCARBON LUBRICANTS

FIELD OF THE INVENTION

This invention relates to a process for preparing synthetic hydrocarbon lubricants using a catalyst comprising tantalum (V) halide/oxide bound to the surface of an inorganic oxide substrate.

BACKGROUND OF THE INVENTION

Olefin oligomers such as those produced in the instant cross oligomerization of Dimersol olefins and linear olefins find use as chemical intermediates. They are, for example, converted to lube oils.

The Dimersol Process is a catalyzed liquid phase oligomerization of lower olefins, particularly propylene and butylene. The catalyst is formed by reacting a nickel compound with a hydrocarbyl halide. The primary product is the dimer with smaller amounts of trimer and tetramer being present. General discussion of the Dimersol Process can be found in *Hydrocarbon Processing*, Vol. 89, pp. 143–149, May 1980 and Vol. 91, pp. 110–112, May 1982. It has been found that Dimersol olefins are quite useful for cross oligomerization with linear olefins followed by hydrogenation to produce synthetic lubricants.

U.S. Pat. No. 4,476,343, issued on Oct. 9, 1984 utilizes the catalyst of the instant invention in a process for oligomerizing olefins to higher oligomers.

SUMMARY OF THE INVENTION

This invention relates to a process for preparing synthetic lubricating materials which comprises reacting the olefin products from the Dimersol oligomerization of propylene and/or butylene and a linear olefin having an average carbon number ranging from about 10 to about 18 in the presence of tantalum (V) halide/oxide-inorganic oxide catalyst, separating out the hydrocarbons which distill above about 660° F. (316° C.) and then hydrogenating the 660° F.+ (316° C. +) hydrocarbons to produce the synthetic lubricants.

DESCRIPTION OF THE PREFERRED EMBODIMENTS

Figure 1:
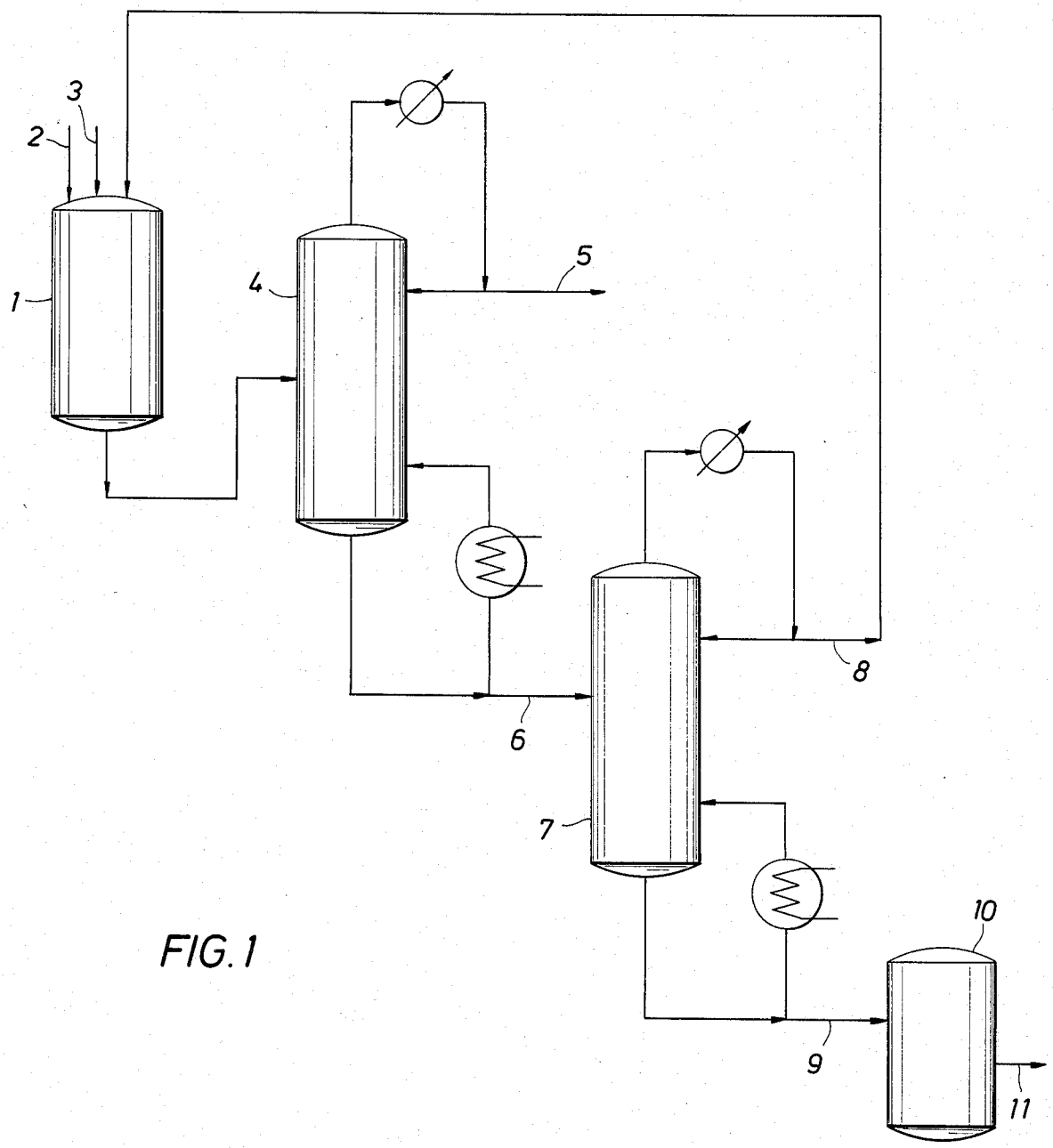
FIG. 1 represents a schematic of the process of the instant invention for preparing lubricating materials.

In this invention, a feed consisting of a Dimersol oligomer product and a linear olefin is cross oligomerized using a tantalum (V)/halide-oxide-inorganic oxide with the portion of the reaction product distilling above about 660° F. (316° C.) being hydrogenated to produce synthetic hydrocarbon lubes or lubricants.

The Dimersol Process is a catalyzed liquid phase oligomerization, primarily dimerization, of propylene and butylene. The process was developed by the Institute Francais du Petrole. In general, the process uses a catalyst prepared by reacting a nickel compound with a hydrocarbyl aluminum halide. Illustrations of the catalyst that can be used in this type of process are given in U.S. Pat. No. 4,366,087, issued Dec. 28, 1982, U.S. Pat. No. 4,362,650, issued Dec. 7, 1982 and U.S. Pat. No. 4,398,049, issued Aug. 9, 1983, all incorporated by reference herein. The Dimersol Process produces primarily dimers with smaller amounts of trimers and tetramers as well as higher oligomers. An illustrative example of the products of this type process is shown in Examples 6 and 10 of U.S. Pat. No. 4,398,049 wherein propylene and butylene are oligomerized to produce 85% of the dimer, 12% of the trimer and 3% of the tetramer. In general, the product of the Dimersol oligomerization of propylene or butylene will result in a product comprising about 75–85% by weight of dimers, 9–15% by weight of trimers, 1–5% by weight of tetramers and less than 5% by weight of the higher oligomers.

The co-feed used in the instant cross oligomerization process is a substantially linear olefin, i.e. at least about 90% linear, which may consist of alpha olefins or internal olefins, with preference given to alpha olefins. A linear olefin suitable for the instant process should have an average carbon number ranging from about 10 to about 18.

As used herein, the term "viscosity index" (VI) refers to the sensitivity of a lubricant's viscosity with change in temperature and is measured by ASTM D-2270. "Kinematic viscosity" refers to the flow property of a material at a defined temperature and is measured by ASTM D-445. "Pour point" refers to the temperature at which a lube no longer flows and is measured by ASTM D-92.

The key to producing the lubricating materials of the instant invention resides in the use of the tantalum (V) halide/oxide-inorganic oxide catalyst. The catalyst comprises pentavalent tantalum (also written as tantalum (V)), halogen (or halide), oxygen (or oxide) and a solid inorganic oxide substrate wherein at least one valence of tantalum is bound to oxygen, which oxygen is bound to the substrate, at least one valence of the tantalum is bound to halogen and the remaining tantalum valences are bound to halogen and/or oxygen, which oxygen may or may not be bound to the substrate. The halogens are fluorine, chlorine, bromine, iodine and mixtures thereof. Preferred halogens are fluorine and chlorine.

The inorganic oxides that are useful as substrates to prepare the catalysts are those inorganic oxides which have hydroxyl groups attached to the surface of the substrate. The hydroxyl groups provide the means by which the tantalum pentahalides are bound by reaction to the surface of the substrate. The scope is broad and any metal or semi-metal oxides which have surface hydroxyl (or oxyhydroxyl) groups can be utilized in preparing the catalysts.

The term "inorganic oxide", although used herein in the singular tense, is meant to include the single oxides such as silica, or alumina as well as plural and complex oxides such as silica-alumina, silica-alumina-thoria, zeolites and clays. The term "semi-metal" is a term referring to the semi-conductor materials like silicon, germanium etc., although in the catalyst art, the semi-metal oxides are frequently encompassed within the term "metal-oxide".

The preferred inorganic oxide substrates used to prepare the catalysts are the porous solid inorganic oxides which contain surface hydroxyl groups and which are conventionally used as catalysts and catalyst supports. Non-limiting examples of these types of materials include those having a major component of silica or alumina or both, such as, for example, alumina and aluminous materials, silica and siliceous materials; clays, particularly open lattice clays; and crystalline aluminosilicates (zeolites). Non-limiting examples of aluminous and siliceous materials include, for example, silica-alumina, silica-magnesia, silica-zirconia, silica-titania, alumina-chromia, alumina-ferric oxide, alumina-titania as well as ternary compositions such as, for example, silica-alumina-titania, silica-alumina-zirconia, etc. Non-limiting examples of crystalline aluminosilicates useful as substrates include synthetic zeolites, such as, for example, A, X, Y, L and ZSM types such as ZSM-5 and others and naturally occurring zeolites, such as, erionite, faujasite, mordenite, sodalite, cancrinite and others. Non-limiting examples of open lattice clays useful as substrates include bentonite, montmorillonite and others. In a preferred embodiment, the metal oxide should have a major component of silica or alumina or both.

Particularly suitable as substrates for preparing the catalysts are those solid inorganic oxide compositions known as metal or semi-metal oxide gels or gel oxides. The gel oxides which are particularly suitable for use in preparing the catalysts are any of the oxide gels that are well known in the catalytic art useful as either catalyst base materials or as supporting materials in catalyst compositions. Additionally, the term "metal or semi-metal oxide gel" or "gel oxide" as used herein shall also include the plural oxide gels, i.e., those that contain mixtures or compounds of two or more metal oxides. A metal or semi-metal oxide gel is basically a metal or semi-metal oxide that contains chemically bound water in the form of hydroxyl groups or oxyhydroxyl groups as opposed to adsorbed water and water of hydration, although adsorbed water and water of hydration may also be present. They are typically prepared by the precipitation of the metal or semi-metal component(s) in an aqueous medium. Upon calcination at sufficiently elevated temperatures, water is given off and the gel is converted to the oxide with two hydroxyl moieties giving one molecule of water and an oxygen is attached to a metal ion. Illustrative of gel oxide base materials used to prepare the catalysts are aluminas, silicas, alumina-silicas, alumina-zirconias, silica-zirconias and the like, including naturally occurring hydrous oxide materials such as clays, such as, for example, the kaolinites, the montmorillonites and the like. Among the clays the open lattice clays are particularly desirable. Also included are the zeolites, both natural and synthetic. The structure of the gel oxides can range from amorphous to highly crystalline. Preferred oxide gel materials are selected from the group consisting of alumina, silica, alumina-silica, crystalline alumino-silicates (zeolites) and open lattice clays.

Since the tantalum (V) halide/oxide is bound to the surface of the inorganic oxide substrate by a reaction of tantalum pentahalide with the inorganic oxide substrate through a hydroxyl moiety, the inorganic oxide substrate must have pendant surface hydroxyl groups attached to the surface. Before reaction, the inorganic oxide substrate must have pendant surface hydroxyl groups, whereas, after reaction, the inorganic oxide substrate may or may not have surface hydroxyl groups, depending on the degree of reaction with the tantalum pentahalide.

Prior to use in preparing the catalysts the hydroxyl-containing inorganic oxide substrate should be substantially free of absorbed water, i.e., "substantially dehydrated or anhydrous". The absorbed or free water is removed by heating the substrate at temperatures ranging from about 100° C. to about 900° C. prior to contact with the tantalum pentahalide vapor. Any environment that provides for drying is suitable such as air, vacuum, inert gas such as nitrogen, etc. The dried metal oxide substrate should be kept away from a humid atmosphere after drying. It is understood that a dried inorganic oxide substrate prior to use in preparing the catalysts will still contain chemically bound water in the form of hydroxide and oxyhydroxide.

An aluminum oxide gel is one of the preferred substrates. This alumina can be any of the variety of available aluminas. These are commercially available under various names such as alumina gels, activated aluminas, gamma aluminas, etc. Regarding purity of the alumina, it may be stated that small amounts of impurities are not generally detrimental, and may be beneficial when the impurity is present as a co-gel. In fact "impurities" may be purposely added for catalytic effects.

The following table lists several commercial aluminas and their properties which are found suitable.

| Alumina | Surface Area, $m^2/g$ | Pore Vol., cc/gm | Na, ppm | $SO_4^=$, % wt | $Fe_2O_3$ % wt | $Cl^-$, % wt |
|---|---|---|---|---|---|---|
| CCI[a] | 252 | 0.8 | 160 | 0.06 | — | 0.02 |
| KA-201[b] | 365 | 0.42 | 600 | 0.03 | — | 0.01 |
| RA-1[c] | 263 | 0.26 | 4700 | 0.02 | 0.18 | — |
| ACCO[d] | 225 | 0.68 | 580 | 0.6 | — | 0.6 |
| Norton | 218 | 0.62 | 51 | 0.03 | — | 0.03 |

[a]Catalysts & Chemicals, Inc., now United Catalysts
[b]Kaiser
[c]Reynolds Corporation
[d]American Cyanamid Corporation
[e]Conoco Corporation
[f]Filtrol Corporation Silica gel is also another preferred substrate. These are readily available commercially and are essentially substantially dehydrated amorphous silica. These materials are available in various density grades, from low density with surface areas ranging from about 100–300 $m^2/g$ to regular density with surface areas up to about 800 $m^2/g$. The commercially available materials are used as dessicants, selective absorbents, catalysts and catalyst supports. Regarding purity of the silica, it may be stated that small amounts of impurities are not generally detrimental and may be beneficial when the impurity is present as a co-gel. In fact, "impurities" may be purposely added for catalytic effects. The following table lists several commercial silicas and their properties which are found suitable.

| Support | Surface Area, $m^2/g$ | Pore Vol., cc/g | Density g/cc | Particle Size |
|---|---|---|---|---|
| Davison* Grade 952 $SiO_2$ | 300 | 1.65 | 0.35 | 70 mesh |
| Davison Grade 59 $SiO_2$ | 300 | 1.15 | 0.38 | 8 mesh |
| Davison Grade 57 $SiO_2$ | 300 | 1.0 | 0.4 | 100 mesh |
| Davison Grade 12 $SiO_2$ | 700 | 0.54 | 0.75 | 20 mesh |
| Davison Grade 03 $SiO_2$ | 750 | 0.43 | 0.7 | 8 mesh (avg) |

*Manufactured by Davison Chemical Div., W. R. Grace & Co.

Other preferred substrates are the aluminosilicates. These materials contain various mixtures of aluminum and silicon oxides. They are readily available commercially and are generally employed as cracking catalysts. Typically they contain from about 50 to about 95, preferably from about 70 to about 90 percent by weight of silica. Illustrations of commercially available alumina-silicas are Davison Grade 980–25 (manufactured by Davison Chemical Division, W. R. Grace & Co.) which contains about 75% $SiO_2$ and 25% $Al_2O_3$ and Davison Grade 980-13 which contains about 87% $SiO_2$ and 13% $Al_2O_3$. These materials can be prepared in a conventional fashion, as for example by co-precipitation, cogellation, or by spray drying.

Encompassed within the term "aluminosilicates" are most of the zeolites. The zeolites are found to be specifically useful as substrates. Zeolites are ordered, porous crystalline aluminosilicates having a definite crystalline structure within which there are a large number of small cavaties which are interconnected by a number of still smaller channels. Zeolites useful as substrates may be either synthetic or natural. At least 34 species of zeolite minerals are known and the synthetic zeolites number in the hundreds. Any zeolite will be useful as a substrate provided that the zeolite, prior to reaction with tantalum pentahalide, contains chemically bound water in the form of hydroxyl groups. Depending on the state of reaction, the reacted product may contain no hydroxyl groups, if all such groups were reacted with the tantalum pentahalide, or there may be unreacted hydroxyl groups still present.

The techniques for the preparation of the tantalum pentahalide intermediates are well known in the art and typically are prepared by passing a dry halogen gas over tantalum metal at elevated temperatures. By way of illustration, tantalum pentachloride is prepared by passing dry chlorine over tantalum metal at a temperature above 200° C. The tantalum pentahalides utilized will comprise tantalum pentafluoride, tantalum pentachloride, tantalum pentabromide and tantalum pentiodide.

The metal oxide-tantalum (V) halide/oxide compositions used in the process of the instant invention are preferably prepared by a process comprising reacting under substantially anhydrous and oxygen-free conditions a suitable gel oxide which has water chemically bound as hydroxyl and which is substantially free from absorbed water with tantalum pentahalide vapor and thereafter recovering the product. The metal or semi-metal oxide catalysts thus produced have tantalum (V) halide/oxide bound to the surface thereof. By the term "bound" it is meant herein that the pentavalent tantalum has at least one valence bound to an oxygen which is part of the inorganic oxide substrate. By the term "surface" it is meant both the external and internal pore surfaces which are accessible to the tantalum pentahalide vapor during the preparative process.

The tantalum pentahalides readily sublime and thus lend themselves to a preferred method of preparation which is called "reactive sublimation" wherein tantalum pentahalide is sublimed into an anhydrous, non-oxidizing atmosphere and allowed to contact and react with the hydroxyl-containing metal or semi-metal oxide.

In the preparation of the catalysts, by reactive sublimation, it is important that the reaction be carried out under substantially anhydrous conditions and in a neutral or reducing environment to prevent decomposition of the tantalum halide.

In this preferred method of catalyst preparation, the tantalum pentahalide is sublimed by suitable application of temperature and/or vacuum into an essentially anhydrous and oxygen-free atmosphere where it is allowed to contact and react with a substantially anhydrous, hydroxylcontaining metal or semi-metal oxide substrate. Any temperature and/or vacuum which causes the tantalum pentahalide to sublime is suitable. Temperatures up to about 200° C. are suitable. Frequently the inorganic oxide substrate is heated during the reaction, say up to about 200° C. This heating is not critical to the preparation of catalysts, but it has been found that by so heating. a more even distribution of the tantalum pentahalide on the metal oxide substrate is effected. After reaction the inorganic oxide composition is frequently subjected to an additional period of time at sublimation conditions without the presence of a tantalum pentahalide source. This extra step allows for any unreacted tantalum pentahalide to be sublimed off of the metal or semi-metal oxide composition. The inorganic oxide substrate before use is frequently subjected to a heat treatment to remove absorbed water. Vacuum can also be applied. Generally, if the pre-treatment temperature is too low, free water will remain, and, if the temperature is too high, sintering of the inorganic oxide substrate will occur, both of which can adversely affect the catalytic properties. Generally, the most desirable pretreatment temperatures of the metal oxide substrate range from about 200° to about 400° C.

It is postulated that when tantalum pentahalide reacts with the hydroxyl group of a inorganic oxide substrate, that the reaction may be illustrated variously as follows (using chloride as an illustrative halide):

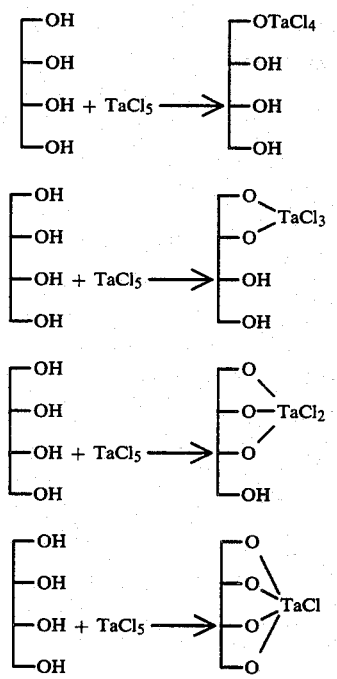

In the final catalyst a mixture of the above described reaction products will exist. The distribution of these reaction products is believed to be affected by reaction conditions, such as temperature. Analysis of chlorine/tantalum ratios in catalysts containing about 8–17% wt. of tantalum show Cl/Ta atomic ratios of from about 2.5:1 to about 3.5 to 1.

Thus, depending on the tantalum content desired in the final catalyst, a tantalum pentahalide vapor is reacted with the hydroxylcontaining metal or semi-metal oxide substrate until a part or the whole of the hydroxyl group population of the metal oxide substrate is exhausted.

The reaction between the tantalum pentahalide vapor and the hydroxyl-containing inorganic oxide substrate is carried out at temperatures ranging from about room temperature to elevated temperatures, say to 150°-200° C. or higher. The reaction is normally carried out in an anhydrous, i.e., free from water vapor, atmosphere. The atmosphere should further be a neutral or reducing atmosphere i.e., oxygen-free. Dispersal of the tantalum pentahalide vapor in a vacuum provides a quite suitable atmosphere for reaction with the metal or semi-metal oxide substrate.

The inorganic oxide-tantalum (V) halide/oxide catalysts may be produced in virtually any physical form, as for example, they may be pellets, beads, extrudates, microspheres and in other particular forms, as for example rings, saddles and the like and in porous or non-porous form.

The catalytic compositions utilized in the instant process basically comprise metal or semi-metal oxide substrates having tantalum (V) halides/oxides reactively bound to the surface of said substrate. The halides are selected from the group consisting of fluoride, chloride, bromide, iodide and mixtures thereof. Preferred halides are fluoride and chloride. The catalysts are generally prepared by a process which comprises contacting the hydroxyl-containing metal or semi-metal oxide substrate in a substantially anhydrous state with tantalum pentahalide in the vapor state and allowing the vapor to react with the substrate in an atmosphere which is substantially oxygen- and water-free. In the preferred process sublimation of the tantalum pentahalide is used to put the tantalum pentahalide in the vapor state. Tantalum pentachloride is the preferred sublimation agent, producing the highest metal loadings on the inorganic oxide substrate.

A variation of the above process is utilized to produce a catalyst containing mixed halides, particular mixed chlorides and fluorides. In this variation a tantalum (V) chloride/oxide-inorganic oxide composition is prepared by reactive sublimation. The tantalum (V) chloride/oxide-metal oxide composition is then contacted with an oxygen-containing gas or a chemical compound containing oxygen which is weakly convalently bonded to the compound. It is postulated that oxygen replaces part of the halide of the composition. The material is then reacted with a liquid or gaseous fluorinated hydrocarbon which is believed to react preferentially with the oxygen bound only to the tantalum, producing, it is postulated, a composition containing various mixtures of chlorides, fluorides, oxides, oxychlorides, oxyfluorides, oxychlorofluorides, etc., depending on reaction conditions. Analyses of catalysts prepared in this fashion show that they contain varying amounts of chlorine and fluorine along with amounts of oxygen (not bound to the substrate) ranging from insignificant to moderate, depending on the degree of fluorination obtained using the fluorinated hydrocarbon. The amount of oxygen remaining can be varied by choice of fluorinated hydrocarbon and reaction conditions. Reaction temperatures and pressures for the reaction with the fluorinated hydrocarbon are not critical. Temperatures of room temperature or greater are generally suitable. Different fluorinated hydrocarbons will have different optimum temperatures, pressures and times of contact, and these can readily be determined by routine experimentation. Particularly suitable fluorinated hydrocarbons are the Freons, such as, for example Freon 12 ($CF_2Cl_2$), Freon 14 ($CF_4$), Freon 23 ($CHF_3$), Freon 112 ($CCl_2F—CCl_2F$), Freon 116 ($CF_3—CF_3$), Freon 142 (chlor-difluor-methyl methane), Freon C138 (octafluorocyclobutane) and similar materials. One particular advantage of this process is that it allows for the preparation of catalysts containing higher amounts of fluoride than does the process using reactive sublimation of tantalum pentafluoride alone. Compositions containing the fluoride are more resistant to oxygen degradation than the compositions containing chloride alone. Thus, when the mixed chloride/fluoride compositions are used as catalysts, the feeds need not be purged of oxygen and air is no longer a poison. Feeds containing oxygen (e.g., $0_2$, peroxide, etc.), however, will still compete for catalyst sites and, hence, the observed rates of reaction can be reduced.

An alternative and preferred variation of the above-described process for producing a catalyst containing mixed halides, particularly mixed chlorides and fluorides, is to delete the step in which the tantalum (V) chloride/oxide-metal is contacted with oxygen or an oxygen-containing compound. In this variation, a tantalum (V) chloride/oxide-inorganic oxide method is prepared by reactive sublimation. The tantalum (V) chloride/oxide-metal oxide composition is then reacted with a liquid or gaseous fluorinated hydrocarbon.

As noted above, a modification of the basic catalyst can be obtained by contacting the tantalum (V) halide-/oxide-inorganic oxide compositions with oxygen or a compound containing oxygen which is weakly covalently bonded to said compound. Illustrative of said compounds are the peroxides and peroxy compounds, both organic and inorganic, the hypohalide's etc. It is postulated that contact of the catalysts with oxygen or the indicated oxygen-containing compounds converts part of the halogen on the composition to oxygen which is not bound to the substrate. Thus, there are two possible types of oxygen bound to the pentavalent tantalum of the composition. One type is the oxygen(s) which is bound to the tantalum and to the substrate. This presence of this type of oxygen is required to produce the catalysts. The other type of oxygen which optionally may be present is oxygen bound only to the tantalum of the catalyst composition. Thus, at least one valence of pentavalent tantalum is bound to oxygen which is bound to the substrate, at least one valence of the tantalum is bound to halogen and the remaining tantalum valences are bound to halogen and/or oxygen which is or is not bound to the substrate. This modification containing the optional oxygen may be effected either inadvertently or purposefully. It may be effected by contact with oxygen or oxygencontaining compounds present as additives or impurities in feed streams when the compositions are used as catalysts.

In the process of the instant invention, Dimersol olefin and linear olefin are reacted together in the presence of the tantalum (V) halide/oxide-inorganic oxide gel catalyst described herein. The oligomerization process is suitably conducted in an inert environment so that the presence of reactive materials such as oxygen is avoided. Reaction conditions are therefore substantially oxygen-free. The precise method of establishing contact between the olefins and the catalyst is not critical. In one modification, the catalyst composition is charged to an autoclave or similar pressure reactor. The olefin co-feeds are introduced, and the reaction mixture is maintained with agitation at a reaction temperature and pressure suitable for the desired reaction.

Another modification comprises passing, in a continuous manner, the olefin reactants through a reaction zone in which the supported catalyst composition is maintained. By this modification, the process is carried out at moderate temperatures and pressures. Suitable reaction temperatures vary from about 25° C. to about 400° C., and preferably from about 100° C. to about 300° C. Sufficient pressure is used to maintain most or all of the co-feeds in a liquid state. Pressures typically range from about 100 psig to about 1000 psig, and preferably from about 300 psig to about 500 psig.

After reaction with the above-described tantalum (V) halide/oxide-inorganic oxide catalyst, the product obtained is separated into individual components such as, for example, distillation. Those materials which distill at a temperature below about 300° F. when adjusted to atmospheric pressure are referred to as "lights". Those materials which distill at a temperature ranging from about 300° F. to about 660° F. when adjusted to atmospheric pressure are referred to as "recycle", which contains unreacted olefin and is recycled into the reactor. Those materials which distill above 660° F. when adjusted to atmospheric pressure are referred to as "lube-ranged olefins". The lube-ranged olefins are hydrogenated to produce the desired synthetic hydrocarbon lubes or lubricants.

Hydrogenation of the lube-ranged olefins is carried out in a conventional manner. Typically, the lube-ranged olefin product is diluted with a solvent such as isooctane and purified over alumina to remove any peroxides which may have formed. Hydrogenation may be carried out in an autoclave or continuous reactor either with or without a catalyst. A catalyst such as, for example, a palladium catalyst would be suitable for use in hydrogenation. Suitable temperatures typically range between about 25° C. and about 300° C. and pressures are in the range from about 100 psig to about 1000 psig. Upon completion of hydrogenation, the material may then be filtered and various lube grades separated out using suitable distillation means.

In order to illustrate the invention more fully, reference is made to FIG. 1 which is a schematic of the process of the instant invention. FIG. 1 is illustrated utilizing a downwardly flow configuration to indicate a direction and not an orientation, and hence, should not be construed to imply an orientation limitation on the process of the instant invention. Item 1 is a fixed bed reactor containing tantalum (V) halide/oxide-inorganic oxide catalyst, while Items 2 and 3 represent the Dimersol olefin feed and the linear olefin feed which are fed into reactor 1. After passage of the feed streams over the catalyst, the material is then passed to a first fractionating zone (Item 4) where the materials which distill at a temperature below about 300° F. (149° C.) are passed through line 5 and the materials boiling above about 300° F. (149° C.) are passed through line 6 to a second fractionating zone (Item 7). The materials boiling below about 300° F. (149° C.) are referred to as "lights" or materials from which an enhanced olefin stream may be recovered in a separate operation if desired. In fractionating zone 7, the cut points are about 300°-660° F. (149°-316° C.) and greater than 660° F. (316° C.). Materials boiling in a range between about 300° F. (149° C.) and about 660° F. (316° C.) constitute a recycle stream which is passed through line 8 and recirculated to reactor 1. Materials boiling at a temperature greater than about 660° F. (316° C.) are referred to as luberanged olefins. These materials are passed through line 9 and passed to hydrogenation zone 10 to produce synthetic hydrocarbon lubricants which are then passed through line 11 and recovered as product.

The process of the instant invention is described below by the following illustrative embodiments which are provided for illustration, and are not to be construed as limiting the invention.

ILLUSTRATIVE EMBODIMENT

Catalyst Preparation

The following illustrates a typical preparation of the catalyst used to make the lubricants of the instant invention. Other examples are given in U.S. application Ser. No. 527,535 filed Aug. 29, 1983, now U.S. Pat. No. 4,489,171 issued Dec. 18, 1984, incorporated by reference herein. In this preparative technique, a glass scrubbing bottle was modified by internally adding a course fritted disc which divided the bottle into a upper section and a lower section. The lower section was fitted with a stoppered connection which allowed it to be charged with tantalum pentachloride and the upper section was fitted with a vacuum stopcock connection which allowed it either to be closed off or connected to a vacuum. To the modified gas-scrubbing bottle were added about 20g of $TaCl_5$ to the bottom section and 60g of Davison 57 silica (−20+30 mesh, pretreated at 300° C. under 0.1 torr vacuum for 12-24 h) to the top section. Both sections were loaded in a dry box containing a nitrogen atmosphere. The bottom section was stoppered and the top section had the vacuum stopcock before removing from the dry box. The bottom section of the bottle was immersed into an oil bath and heated at about 150° C. The top section was wrapped with heating tape and heated to about 150° C. A vacuum (about 0.1 torr) was applied at the top of the bottle. The heating and vacuum phase of the preparation was simultaneous and carried out over a period of 18 h. At the end of 18 h, the bottle (vacuum stopcock closed) was put back into the dry box and 20 g of fresh $TaCl_5$ was added to the bottom section. The rest of the procedure was then repeated for another 18 h. Then the silica was removed, in a nitrogen-filled dry box, and vertically sublimed at 150° C. and 0.1 torr for 18 h. This step was employed to remove any deposited but unreacted $TaCl_5$ on the silica surface. A small (,200 mg) of $TaC1_5$ was generally collected on the cold finger of the sublimator.

Twelve milliliters of the tantalum (V) chloride-silica composition was added to a fixed-bed flow reactor and treated with Freon 12 ($CF_2Cl_2$) at 200° C. and 70 psi at a flow rate of 2.4 liters/hr for 5 hours. The flow tube was then sealed and left under an atmosphere of Freon 12 at 200° C., 75 psi for 60 hours. Analysis of the resultant composition by neutron by neutron activation showed it to contain about 15.7 % w Ta, 1.9 % w Cl and 5.7 % w F.

Lubricant Preparation

A feed containing about 80% by weight $C_8$ olefin purified from Dimersol and about 20% by weight $C_{14}$ alpha olefin is passed through a bed of alumina at a rate of 300 ml per hour to purify the feed. The purified feed is then fed up-flow through a fixed-bed reactor containing 30 cc of catalyst prepared similar to that described above and packed such that there are no void spaces which would allow the catalyst to move during operation.

The reactor is initially heated to about 100° C. at a pressure of about 500 psig and a liquid hourly space velocity of about 10 $h^{-1}$. After about 6 hours, the temperature is increased to about 150° C. At the end of about 24 hours, the paraffin level is checked and the $C_8$ olefin conversion is determined. Following the "break-in" period, space velocity and temperature are adjusted as appropriate to maintain a $C_8$ olefin conversion of 35–45% and a paraffin level of less than 5%. The reaction product is then distilled under vacuum as required to maintain a pot temperature below 350° F. (177° C.) with cut points, when adjusted to atmospheric pressure, being materials boiling lower than 300° F. (149° C.) and materials boiling higher than 300° F. (149° C.). The materials boiling at less than 300° F. (149° C.) are referred to as "lights" from which one could recover an enhanced octene stream in a separate operation. The materials boiling higher than 300° F. (149° C.) are then further distilled with cuts at 300°–660° F. (149°–316° C.) and 660° F.+ (316° C.+). The 300°–660° F. (149°–316° C.) cut is recycled into the reactor forming a recycle stream. The 660° F.+ (316° C.) cut is lube-ranged olefin which is then hydrogenated.

Hydrogenation of the lube-ranged olefins is carried out in a one-gallon, stirred autoclave. The 660° F.+ (316° C.+) cut is diluted in isooctane and purified over neutral alumina to remove any peroxides that might be present. The solution to be hydrogenated is then stirred for about 4 hours, filtered, and then immediately hydrogenated. Hydrogenation is carried out with a palladium catalyst at a temperature ranging from about 100° C. to about 200° C. and a pressure between about 350 psig and about 400 psig. Hydrogenation should be continued for a length of time sufficient to obtain a bromine number less than 0.1. After hydrogenation is completed, the material is filtered and distilled to separate out the desired hydrocarbon lubricant.

Lubricating materials prepared in this manner had a viscosity index (VI) of 104, a kinematic viscosity of 5.0 cSt at 100° C. and a pour point of −38° F. For purposes of comparison, a similar lubricating material made utilizing a rare earth Y-zeolite catalyst had a viscosity index (VI) of 64, a kinematic viscosity of 4.1 cSt at 100° C. and a pour point of −45° F. Thus, lubricating materials made utilizing the process of the instant invention show an improvement in viscosity index of 40 when compared to lubricating materials prepared utilizing the rare earth Y-zeolite catalyst.

I claim as my invention:

1. A process for preparing synthetic lubricating materials which process comprises:

(a) reacting (i) at least a portion of a reaction product of the liquid phase oligomerization of propylene, butylene or mixtures thereof containing a $C_6$ olefin component, a $C_8$ olefin component or mixtures thereof, which reaction product was formed by reacting propylene, butylene or mixtures thereof with a catalyst prepared by reacting a nickel compound with a hydrocarbyl aluminum halide, with (ii) a linear olefin reactant having an average carbon number ranging from about 10 to about 18 in the presence of a catalyst comprising pentavalent tantalum, halogen, oxygen and an inorganic oxide substrate wherein at least one valence of tantalum is bound to oxygen which is bound to the substrate, at least one valence at the tantalum is bound to halogen and the remaining tantalum valences are bound to halogen, oxygen or mixtures thereof which may or may not be bound to the substrate, (b) separating from the reaction mixture of (a) the hydrocarbons which distill at a temperature above about 660° F. (316° C.), and (c) hydrogenating the reaction product of (b) by contact with hydrogen with or without a catalyst at a temperature ranging from about 25° C. to about 300° C.

2. The process of claim 1 wherein in step (a)(i), the portion of said reaction product separated out is the $C_6$ olefin component of the total reaction product.

3. The process of claim 1 wherein, in step (a)(i), the portion of said reaction product separated out is the $C_8$ olefin component of the total reaction product.

4. The process of claim 1 wherein, in the catalyst of step (a)(ii), said halogen is chloride, fluoride or a mixture thereof.

5. The process of claim 1 wherein, in the catalyst of step (a)(ii), said substrate is silica, alumina, silica-alumina, zeolite, open lattice clay or mixtures thereof.

6. The process of claim 1 wherein, in the catalyst of step (a)(ii), said substrate has a major component of silica or alumina or a mixture thereof.

* * * * *